US005308059A

United States Patent [19]

Owen, Jr. et al.

[11] Patent Number: 5,308,059

[45] Date of Patent: May 3, 1994

[54] BASKETBALL PRACTICE ASSEMBLY

[75] Inventors: Aubrey J. Owen, Jr., P.O. Box 177, Rowley, Mass. 01969; Henry E. St. Louis, Jr., Georgetown, Mass.

[73] Assignee: Aubrey J. Owen, Jr., Rowley, Mass.

[21] Appl. No.: 590

[22] Filed: Jan. 5, 1993

Related U.S. Application Data

[63] Continuation of Ser. No. 720,006, Jun. 24, 1991, abandoned.

[51] Int. Cl.[5] ..... A63B 63/08

[52] U.S. Cl. ..... 273/1.5 R; 411/340; 273/1.5 A

[58] Field of Search ..... 273/1.5 R, 1.5 A; 411/340, 344, 345, 354

[56] References Cited

U.S. PATENT DOCUMENTS

| | | | |
|---|---|---|---|
| 403,131 | 5/1889 | Penrose | 411/340 X |
| 2,253,649 | 8/1941 | Price | 248/222.4 X |
| 2,682,403 | 6/1954 | Beck | 273/1.5 R |
| 2,708,576 | 5/1955 | Veruilen | 273/1.5 A |
| 5,022,649 | 6/1991 | Traub et al. | 273/1.5 R |

FOREIGN PATENT DOCUMENTS

| | | | |
|---|---|---|---|
| 982 | of 1902 | United Kingdom | 411/354 |

OTHER PUBLICATIONS

Basketball Coaching & Training Aids, 1989 School Mail Order Catalog, Korney Board Aids pp. 8 & 17.

*Primary Examiner*—Paul E. Shapiro
*Attorney, Agent, or Firm*—Nixon & Vanderhye

[57] ABSTRACT

A basketball hoop assembly for improving a basketball shooter's accuracy in shooting a basketball. The assembly includes a frame support which is attachable to a backboard. A plurality of different diameter hoops beginning with the largest or "regulation" diameter, and stepping smaller in diameter each have their own bracket for mating with the frame support. The smaller diameter hoops have longer frames so that the horizontal distance between the center of each hoop and the backboard, is equal for all the different hoops of the assembly.

4 Claims, 5 Drawing Sheets

BASKETBALL PRACTICE ASSEMBLY

This is a continuation of application Ser. No. 07/720,006, filed Jun. 24, 1991, now abandoned.

BACKGROUND OF THE INVENTION

1. Field of the Invention

This invention relates to basketball practice devices, and more particularly to a basketball hoop assembly which permits greater basketball accuracy by utilizing a plurality of hoop sizes during the practice sessions.

2. Prior Art

Basketball players have been attempting for generations to improve their shooting capabilities. In addition to long hours of shooting practice, basketball players and inventors have attempted to provide devices for helping the players achieve their aims. One such early device is shown in U.S. Pat. No. 1,904,836 to Peoples. A standard basketball hoop is attached to a backboard. An inner ring, is attached by hook means to the standard basketball ring, so as to present a smaller hoop within the larger hoop.

A further device of a multiple hoop nature, is shown in U.S. Pat. No. 2,918,283 to Marschalk. This patent shows a basketball practice device with a C-shaped ring which is connectively attached to the top side of a regulation sized basketball hoop. This upper- most ring has a frontal segment which is missing. The gap or open segment in the top most ring permits manipulation of the ring so as to easily remove it or attach it to the regular ring.

U.S. Pat. No. 4,613,135 to Rush shows a ring replacement arrangement to enable players to change from the standard diameter ring to a larger diameter ring f or players of limited ability.

U.S. Pat. No. 2,694,572 to Crisp shows a basketball practice device comprising a plurality of concentric rings which are supported upon the top of a hoop to facilitate the rebounding of the basketball. U.S. Pat. No. 3,348,840 to Dix shows a rebounding apparatus which attaches to the top of a basketball hoop to permit the basketball to bounce back from the top of the ring.

Breakaway or slam-dunk mechanisms are somewhat more recent. U.S. Pat. No. 4,365,802 to Ehrat shows a swingable mount for a basketball hoop. A large compression spring is attached to the backside of the basketball board. A shaft through the spring attaches through the board into the basketball hoop. The spring permits a resilient return of the hoop once it has been knocked out of place and down angularly. U.S. Pat. No. 4,438,923 to Engle et al shows a shock absorber set up to permit pivoting of a single basketball hoop about an axis.

A further breakaway arrangement for a basketball hoop, is shown in U.S. Pat. No. 4,534,556 to Estlund et al having a backboard with a tension spring extending therethrough and a release finger which holds the basketball hoop within its regular position. Force on the basketball hoop causes the finger to release and tension on the spring keeps the basketball hoop from excessive movement. Another breakaway basketball device is shown in U.S. Pat. No. 4,676,503 to Mahoney wherein an arrangement of springs or lever arms work adaptively to permit a basketball hoop to pivot in front of the backboard.

U.S. Pat. No. 4,465,277 to Dittrich shows a somewhat complicated basketball goal structure wherein a plurality of parallel arm linkages and shock absorbers are arranged to hold a basketball hoop an elongated distance from the support.

It is an object of the present invention to provide a basketball hoop arrangement which facilitates basketball players improvement in "making a basket" on a regulation size rim.

It is a further object of the present invention to provide a kit wherein a basketball assembly has a series of improvement capabilities which are stepped so as to permit a gradual sharpening of a shooters skill.

It is yet a still further object of the present invention to provide an improved breakaway support for the basketball hoop assembly of the present invention.

BRIEF SUMMARY OF THE INVENTION

The present invention comprises a unique assembly of basketball hoops which are utilized to improve the accuracy of a basketball shooters skill. The basketball hoop assembly comprises a basketball hoop having standard circular dimensions having a bracket attached on one side thereof. The bracket is adapted to be mounted to a frame which frame is secured to a basketball backboard. The basketball hoop is of a regulation or standard fixed distance from the basketball backboard. The standard basketball hoop and bracket may be released from the frame and replaced by a basketball hoop of a slightly smaller dimension. The smaller dimensioned hoop has a slightly longer bracket, so that the center of the subsequent (smaller) hoop is the same distance from the backboard as was the standard regulation size basketball hoop. Several of these hoops may be utilized in a step wise reduction in overall diameter, so as to sharpen or refine a basketball shooters concentration and capability as one practices on smaller than regulation size ring. As a basketball shooters proficiency increases on the smaller rings, shooting concentration, capability and confidence will improve when one plays again on the regulation size rim. Each successive diameter hoop has the same center location as does a standard basketball hoop. The only difference is that successively smaller diameter basketball hoops have proportionately longer brackets attached thereto, the brackets each successively attaching to the common frame mounted on the backboard. Replacement of one bracket for another bracket only changes the size of the hoop not the distance of the center of the hoop from the backboard.

In one embodiment of the present invention, a ring breakaway mechanism is supported on the frame which is attached to the backboard. The breakaway mechanism includes a piston and cylinder which is pivotable about a horizontal axle attached to the back frame. The piston, acting as a shock absorber has a shaft extending therefrom which is attachable to a horizontally disposed axle which shock absorber is compressively adapted so as to engage the bracket of a basketball hoop into the extending portion of the frame. The second compressive pin is attached to the frame member to act as a pivot access for the bracket and the first compressive pin assembly which is attached to the piston and cylinder unit. The appropriate force on the basketball hoop causes the piston and cylinder to compress and the pin to act as a cam follower within a slot in the support frame. The shock absorber or piston and cylinder unit cause the basketball hoop to return to its normal horizontal configuration once the force has been removed. Successively sized basketball hoops from the regulation size and smaller, may be removed from the breakaway apparatus by compression of the two pins in each axle arranged between the bracket and the support frame. Compression of each of these springs permits the pins to be withdrawn from their relationship between the hoop bracket and the frame, thus permitting a successive different horizontal length bracket and different size hoop to be readily installed onto the backboard.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
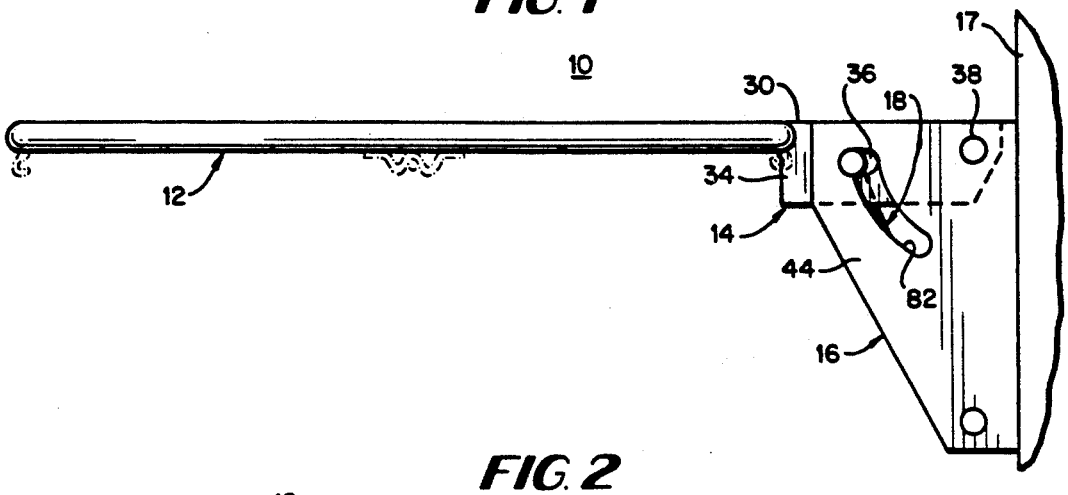
FIG. 1 is a side view of a basketball hoop having a bracket attached to one side thereof, the bracket mounted in a frame, which frame is attachable to a basketball backboard.

Referring now to the drawings in detail, and particular to FIG. 1, there is shown a basketball hoop assembly 10, in a side elevational view, including a first hoop 12, a hoop bracket 14 secured to an arcuate segment 16 of the first hoop 12, the hoop bracket 14 pivotably adapted onto a frame support 16. The frame support 16 is normally attached to a vertically disposed backboard, 17.

The first hoop 12 is a standard (regulation) size circular hoop of 18 inches in inner diameter, having a center point "C" which is held the regulation distance "D" of 15 inches from a backboard. The first hoop 12 is being held by its bracket 14 comprised of an inverted generally channel or U-shaped member, the requisite distance "D" from the backboard.

The frame support 16 may include a hinge mechanism 18 arranged therewith, as partially shown in FIG. 1 and shown more explicitly in FIGS. 2–7.

Figure 2:
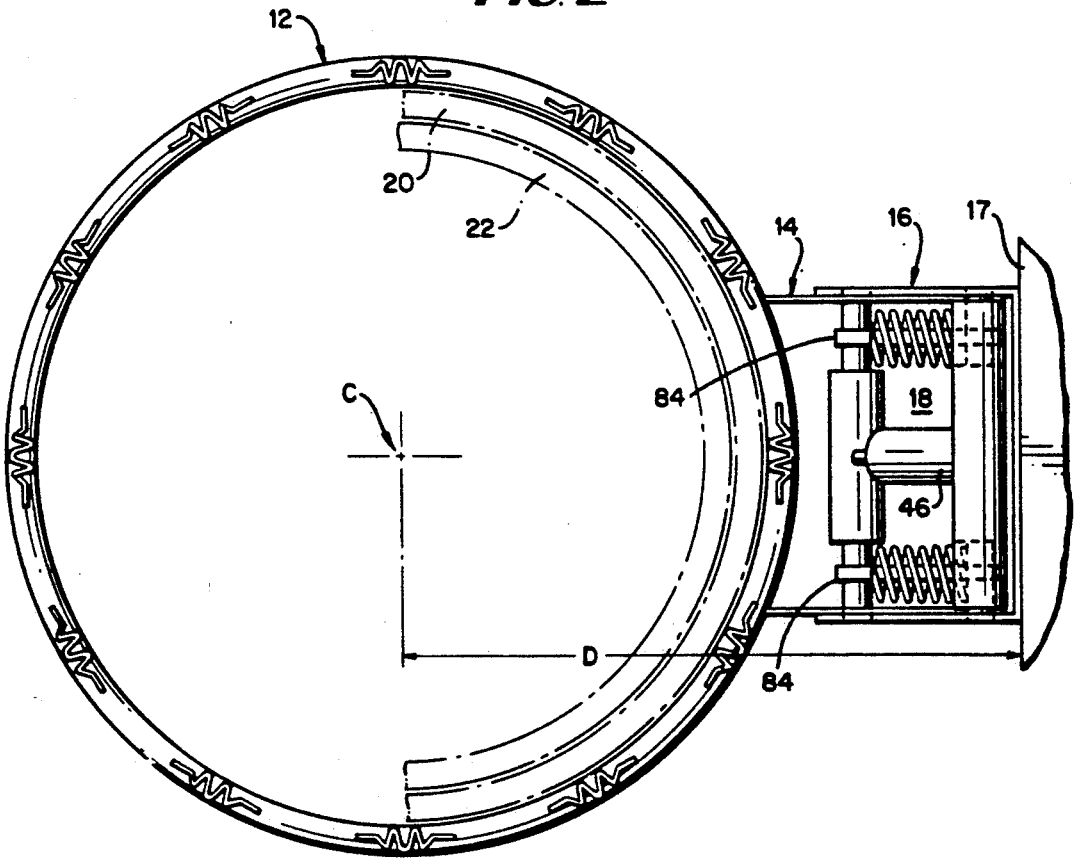
FIG. 2 is a view looking vertically upwardly f rom beneath a basketball hoop assembly of the present invention including the breakaway assembly device.

The present invention also includes at least a second hoop 20, shown in the upwardly directed view of the hoop assembly 10, in FIG. 2. The second hoop 20 is shown in phantom lines and has a diameter of 16½ inches, having the same center point "C" as the first hoop 22. A third hoop 22, also, shown in FIG. 2 in phantom lines, has a diameter of about 15 inches. The second hoop 20 and each subsequent hoop 22 et al, each have their own bracket, similar to the bracket 14 as shown for the first hoop 12, except that each respective bracket is slightly longer horizontally (the difference of the radius between the successive hoops) to make up proportionately for the reduction in diameter of their respective hoops 12, 20 and 22, so that each hoop 12, 20 and 22 will have common center points, that is, the distance from the backboard 17, will be the same. This is critical to the invention.

When a basketball player is adequately experienced on a "regulation" or standard size ring 12 and wants to improve his/her game, ideally they would install the next smaller size hoop 20 and work downwardly in diameter from that one, to ultimately install the smallest diameter hoop 22 and its associated attached bracket,, to the frame support 16, through the hinge mechanism 18, to the backboard. The basketball shooters see only a single hoop, albeit a smaller diameter one initially, as their only target. Over time, as they practive on the smaller hoop 22, their concentration and precision shooting improves. After becoming proficient on the smaller hoop 22 they could return to using the standard "regulation" size hoop 12 and realize an increase in shooting concentration, ability and confidence. To further improve in these areas, the player could install the next smaller hoop 22 with its own bracket, and continue to practice until proficiency at this more difficult level is achieved. It is critical also, that the basketball shooters see only the rim of a single hoop when they are throwing the basketball, whether the hoop is small, intermediate or of standard diameter hoop. The single rim of a hoop of a nonstandard size hoop, each with the "from backboard to center of hoop" distance the same, permits a basketball shooter to improve his game as he positively adapts to the stepwise changes in the size of the hoops. The more time spent practicing on the smaller than "regulation" size hoops, the greater will be ones proficiency and skills when he returns to the full "regulation" size hoops 12.

Each hoop 12, 20 and 22 et al, each having its own bracket 14, differing only in their length by an amount equal to the difference in the radius of the successive hoops, is readily attached and detached from the frame support 16. Each bracket, as exemplifed by the bracket 14, is the same, except for its length, as aforementioned. Each bracket then, of U-shaped configuration, has a planar upper portion 30, as may be seen in FIGS. 1 and 4, and it has downwardly directed side flanges 32 and 34. Each side flange 32 and 34 has an elongated slide opening 36 and a pivot opening 38 at its distalmost end, as shown in FIG. 1.

Figure 5:
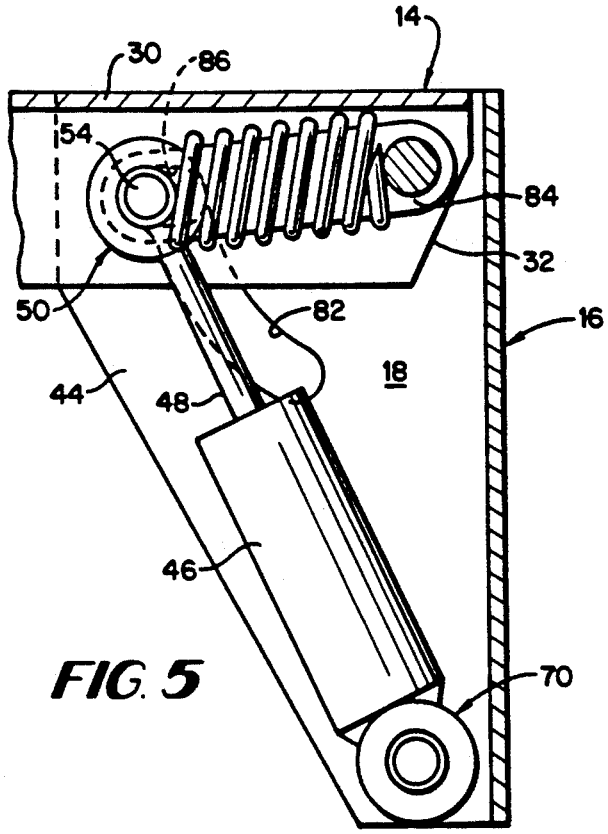
FIG. 5 is a side elevational view of a portion of the breakaway assembly in the frame and bracket arrangement.
Figure 6:
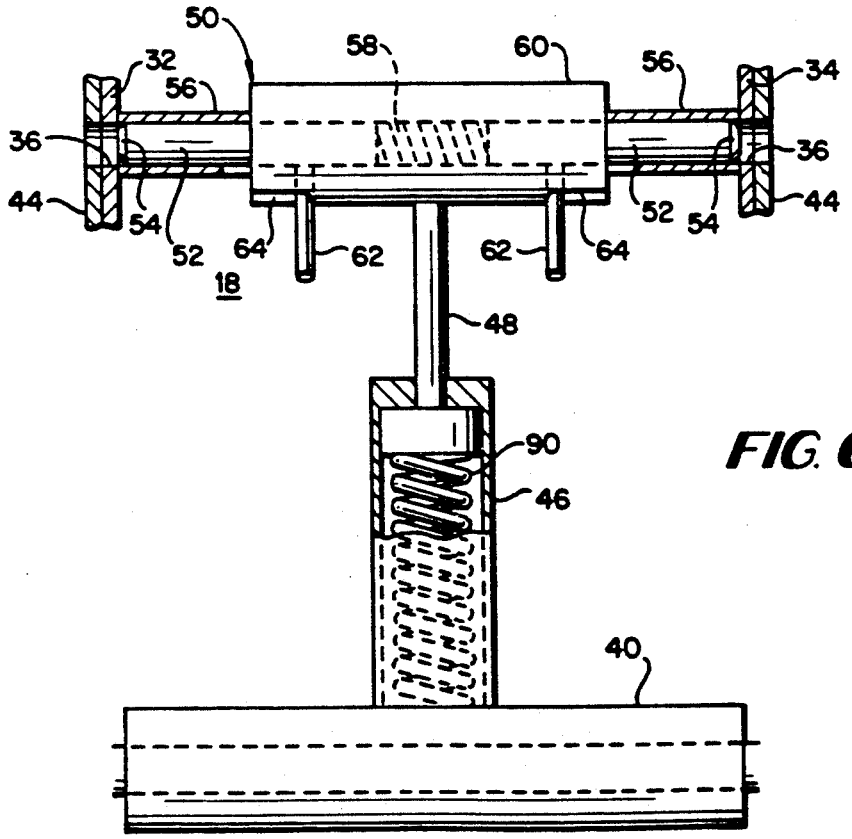
FIG. 6 is a presentation of the piston and cylinder arrangement with one of the compressive pins adapted between a portion of the bracket and the frame, portions being cut away for clarity of the illustration.

The hinge mechanism 18 permits in its preferred embodiment, a slam-dunk of any basket hoop 12, 20 or 22. The hinge mechanism 18, a shown in FIGS. 2–7, comprises a lower pivot axis 40 fixedly disposed through a pair of openings 42, one each in the lower side flange 44 of the frame support 16, as shown in FIG. 1. A compressible piston and cylinder arrangement 46 is secured to the mid point of the lower pivot axis 40. A longitudinally recipricable piston shaft 48 extends out of the piston and cylinder arrangement 46, in a known manner. The piston shaft 48 has a distal end which is attached to the mid-point of a first quick release compressive axle 50. The first compressive axle 50 has a pair of pins 52 the outer ends 54 of which extend through the elongated hole 36 in the side flanges 32 and 34 of the bracket 14, as shown in FIGS. 1 and 5. The pins 52 of the first compressive axle 50 are held in a barrel 56, and are separated by a compressive spring 58, in a housing 60, to which the barrels 56 are attached, as shown in FIG. 6.

Each pin 52 has a thumb latch 62 arranged at its inner end, which latch 62 is in sliding engagement with a slot 64 at of the housing 60. Pushing together manually of the latches 62 compresses the spring 58, and withdraws the ends 54 of the pins 52 from the openings 36 in the bracket 14.

Figure 3:
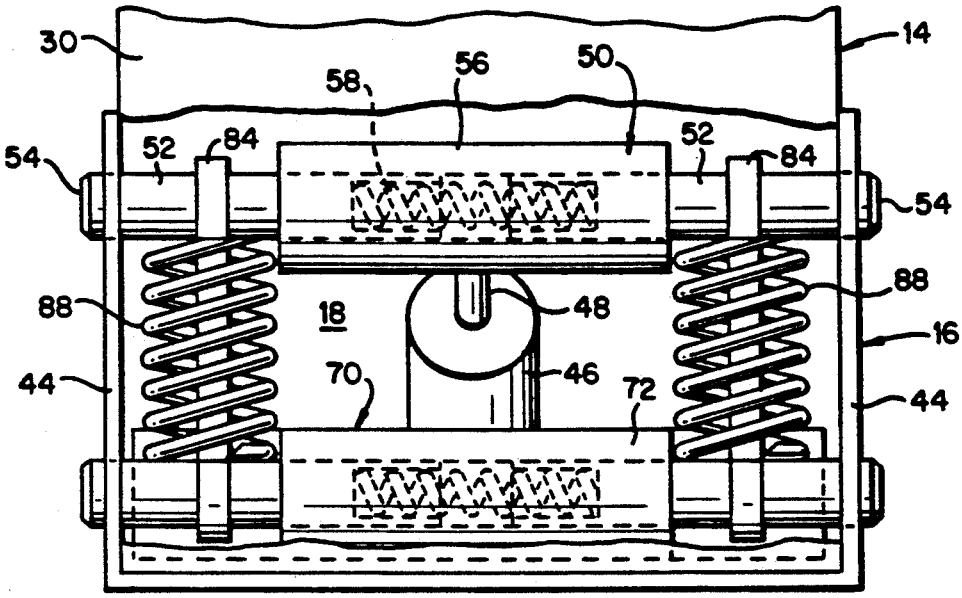
FIG. 3 is a plan view of the breakaway assembly component with portions of the bracket cut away for clarity of illustration.
Figure 4:
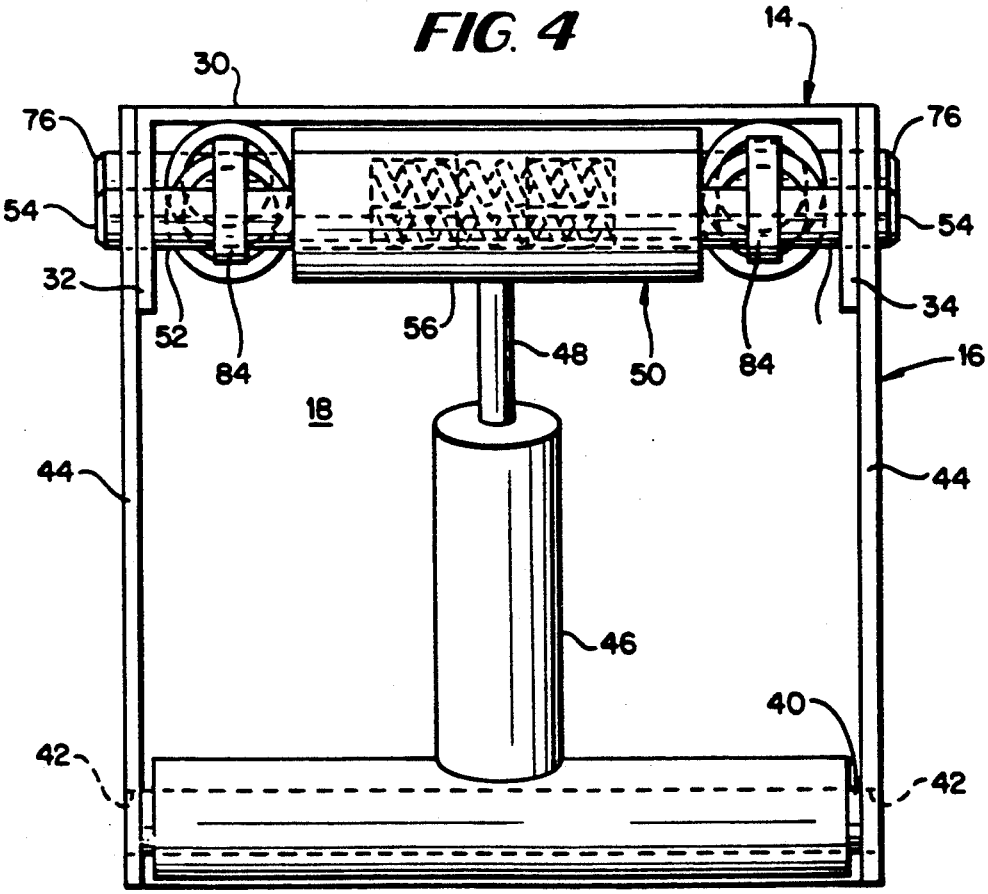
FIG. 4 is a front elevational view partly in section, of the bracket and breakaway assembly arranged within the frame.
Figure 7:
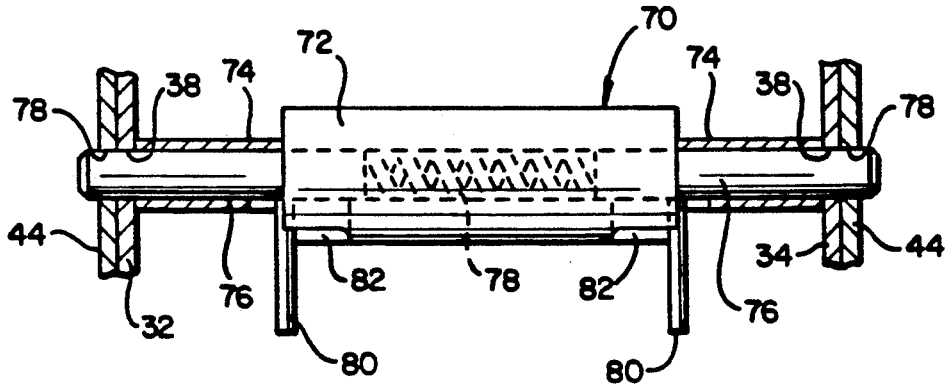
FIG. 7 is a side elevational view of the second pin assembly in the breakaway assembly with portions deleted for clarity of the illustration.

A second quick release-type compressive axle 70 is shown in FIG. 3, and is shown partially, behind the first compressive axle 50 in FIG. 4, and is shown most completely in FIG. 7. The second compressive axle 70 comprises a tubular housing 72 having a barrel 74 extending at each end thereof, as shown best in FIG. 7. A pin 76 is movably disposed within each barrel 74. A compressive spring 78 is arranged within the housing 72 between the inner ends of the pins 76. Each pin 76 is retractably disposed through the pivot opening 38 in each side flange 32 and 34 of the hoop bracket 14, and through a corresponding opening 78 in the side flange 44 of the frame support 16. Each pin 76 has a latch 80 secured to its inner end, similar to that of the first compressive axle 50. A slot 82 longitudinally arranged at the each end of the housing 72 permits the latches 80 to be squeezed together to compress the spring 78 to withdraw and retract the pins 72 from interlocking engagement with the aligned openings 38 and 78 in the side flanges 32 and 34 of the bracket 14 and the side flanges 44 of the frame support 16, to permit the second compressive axle 70 to be removed while changing from one hoop size to another on the frame support 16. The second compressive axle 70 is the pivotal axis, which allows the slam dunk of the hoops to take place.

The distal ends 54 of the pins 52 in the first compressive axle 50 are allowed to slide a slight in "S-shaped" curvilinear cam slot 82 arranged in the side flanges 44, as shown in FIGS. 1 and 5.

An elongated link 84 is articulably disposed between the first and second compressive axles 50 and 70, as shown in FIGS. 2, 3, 4 and 5. Each link 84 has an opening therein which mates about the barrel 74 at each side of the housing 72. Each link 84 has an elongated slot 86 at its forward end. The slot 86 is disposed about each pin 52 of the first compressive axle 50. A compressive spring 88 is disposed about each link 84 biasing the first and second compressive axles 50 and 70 apart.

During a "slam dunk" play, a basketball player hits the hoop 12, 20 or 22 et al with a downward force causing a slight rearwardly directed motion of the first comressive axle 50 within the slots 86 in the links 84 and a tracking downwardly of the pins 52 in the slight "S"-shaped cam slot 86 in the side flanges 44 of the frame support 16, allowing whichever hoop 12, 20 or 22 and its respective bracket 14 being utilized, to pivot downwardly about the second compressive axle 70 holding its place securely within the aligned openings 38 and 78 between the bracket flanges 32/34 and the frame support side flanges 44. The piston and cylinder arrangement 46, shown in a sectional representation in FIG. 6, compresses by receiving the inwardly directed piston shaft 48, compressing a spring 90 therewithin.

Upon removal of the downward force upon the hoop 12, 20 or 22, the spring 90 thus pushes that hoop 12, 20 or 22 into its normal horizontal orientation, the distal ends 54 of the pins 52 snapping into the uppermost end of the cam slot 82 and the forwardmost end of the elongated opening 86 in each link 84.

Figure 8:
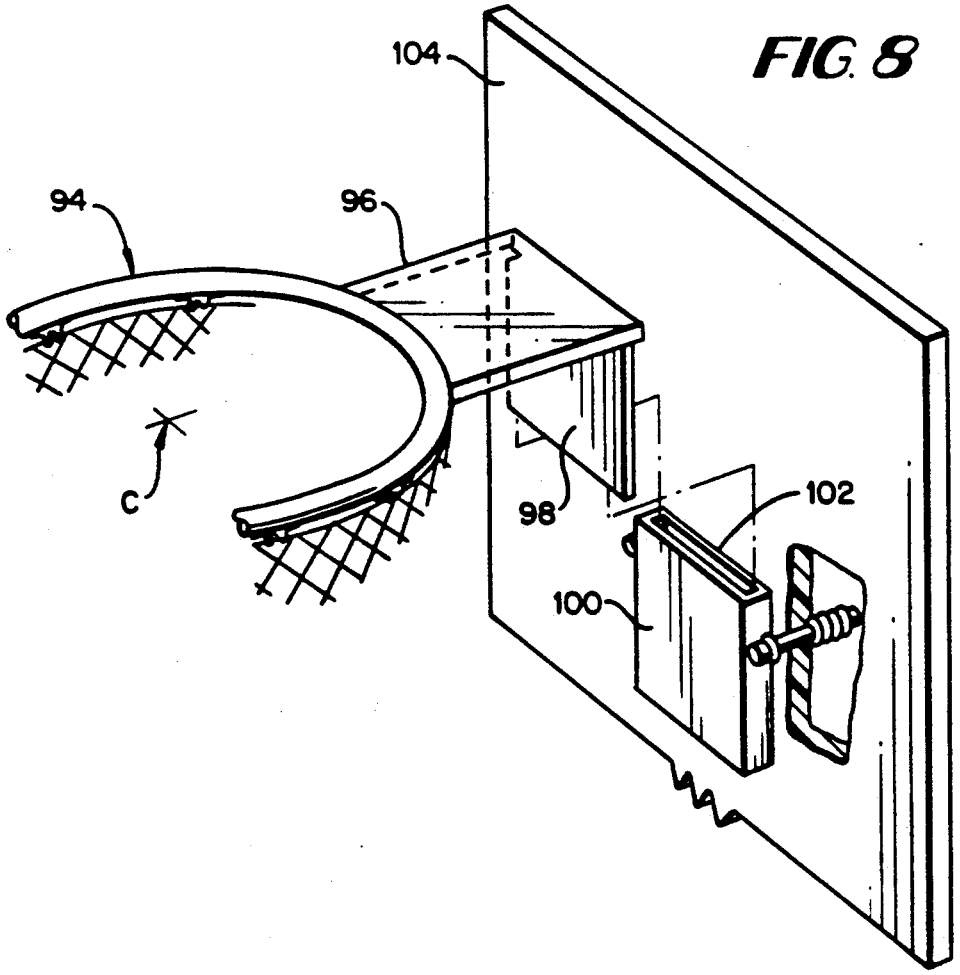
FIG. 8 shows a further embodiment of a basketball hoop with a bracket and frame assembly attached to a backboard.

A further embodiment of a basketball hoop according to the present invention is shown in FIG. 8, wherein a basketball hoop 94 has a bracket 96 attached at one side thereof. The bracket 96 comprises an "L"-shaped arrangement, having a downwardly directed flange 98 which is received in a housing 100 having an elongated receiving slot 102. The housing 100 is secured to a backboard 104. The hoop 94 has a center identified in FIG. 8, as "C". A hoop of a smaller diameter, but a correspondly longer bracket would be secured to successively smaller hoops, so as to keep the center point "C" equidistant from the backboard 104 as any other hoop and bracket in an assembly or kit which comprises the array of multisized hoops and their associated multilength ("C" to backboard) brackets.

Figure 9:
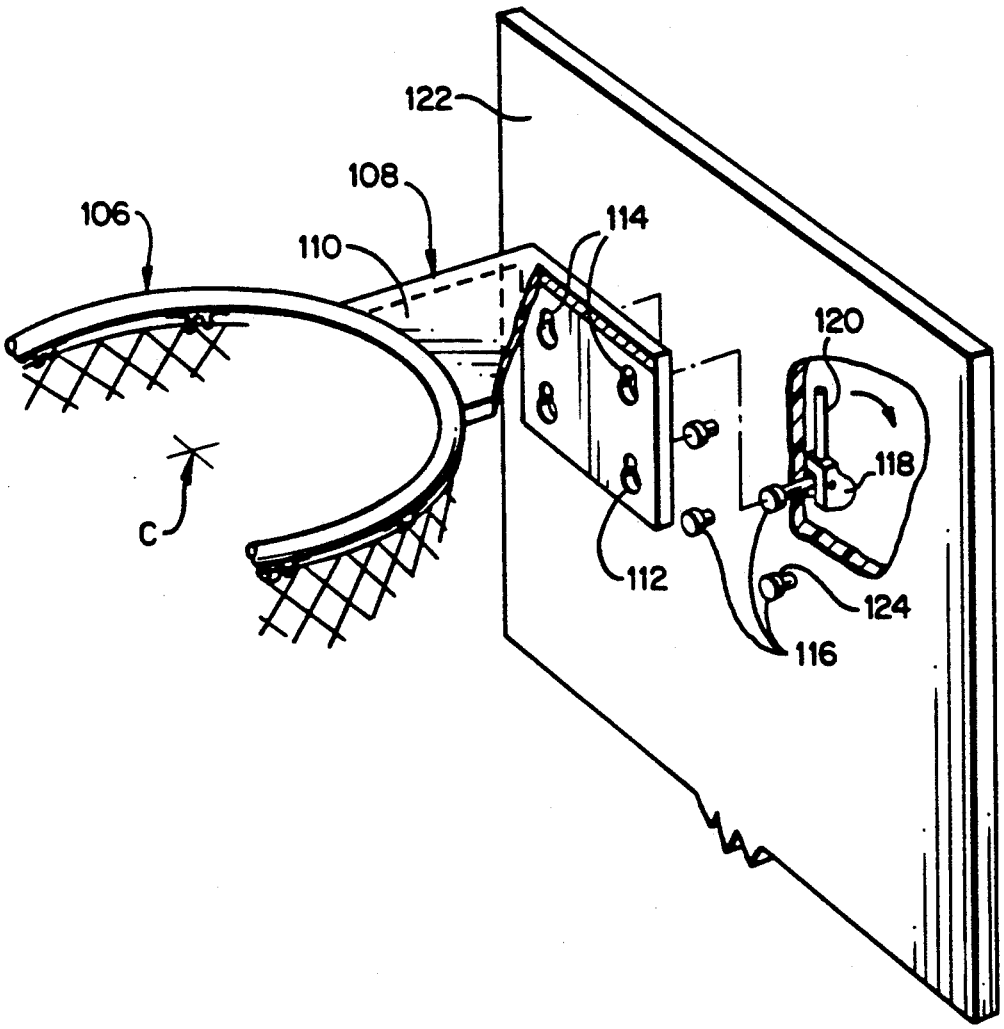
FIG. 9 is yet a further embodiment of a basketball hoop and bracket assembly on a quick release support mechanism on a backboard.

A yet further embodiment of a multi hoop quick change arrangement is shown in FIG. 9, wherein a basketball hoop 106 of one particular diameter, having a center point "C" is shown with "L"-shaped bracket 108 attached thereto. The "L" shaped bracket 108 has an upper portion 110 and a downwardly directed flange 112. The flange 112 has a plurality of elongated slots 114 having wider open portions at the lowermost portion of those slots 114, as shown in FIG. 9. Each slot 114 may receive an adjustable bolt 116, which bolts 116 have a pivotable cam fixture 118 on their rearward end. Pivotable movement of an arm 120 pivots the cam fixture 118 into or out of frictional engagement with respect to the backside of the backboard 122. The bolts 116 have heads 124 which pass through the wide portion of the slots 114 and secure the flange 112 to the backboard 122 once the bracket 108 and the narrow upper ends of the slots 114 have been properly set into its location vis-a-vis the bolts 116. One size hoop 106 may readily be changed to a hoop of a smaller (or larger) diameter, with its respectively longer (or shorter) upper portion 110 of the bracket 108, so that the center point "C" of each particular hoop 106 is equidistant from the backboard 122.

Thus, what has been shown is a plurality of different diameter hoops beginning with a "regulation" diameter hoop with one particular length bracket and to smaller hoops have longer horizontal portion brackets so that the different diameter hoops all have a common center point equidistant from its backboard, once they have been properly secured thereto. It is critical to this invention that the basketball player see only one hoop when shooting the basketball, and that each different size hoop be equidistantly spaced from the backboard when they have been changed one hoop for the other. The various size hoops can be all attached to a common support means on a backboard, the differing length brackets having a common attachment arrangement adaptable to the common support means on the backboard. The plurality of hoops and brackets may be configured as part of a kit or it may be arranged to be retrofitted to an existing backboard.

It is intended that the appended claims be interpreted in an exemplary and not a limiting sense.

We claim:

1. A basketball hoop assembly for improving the shooting accuracy of a basketball player, comprising:

a basketball frame support means for attachment to a basketball backboard, and including an articulable slam dunk mechanism;

a plurality of interchangeable basketball hoops, each having a different diameter, each of said hoops having a bracket fixedly secured thereto and adapted to securely engage its respective hoop to said frame support means such that a center point of each different diameter hoop is equidistant from the backboard when any one of said hoops is engaged with said frame support means;

wherein said frame support means further comprises a first axle and a second axle arranged to secure said bracket engaged therewith; and further wherein said first and second axles comprise a pair of pins extending from each end of a tubular housing, each of said pins having a compression means therebetween to bias said pins outwardly so as to effectuate mating engagement between said bracket and said frame support means.

2. A basketball hoop assembly for improving the shooting accuracy of a basketball player as recited in claim 1, wherein each of said pins has a latch to permit manual displacement of said pins from said bracket by compressing said compression means, thus allowing a basketball hoop bracket to be removed from said frame support means and replaced with a basketball hoop of different diameter.

3. A method of improving the shooting accuracy of a basketball player playing the game of basketball, comprising the steps of:

(a) attaching a first basketball hoop of a first diameter and an attached bracket of a first length, to a frame support on a backboard, wherein said basketball hoop has a center point which is a predetermined perpendicular distance from the backboard;

(b) removing said first basketball hoop of said first diameter with its respective bracket of said first length from said frame support;

(c) attaching a second basketball hoop of a second diameter different than said first diameter and a bracket of a second length to said frame support, so that said second basketball hoop has a center point located said predetermined perpendicular distance from the backboard; and (d) providing a slam dunk mechanism on said frame support so as to allow either of said first and second basketball hoops, when secured to said frame support, to pivot downwardly when a force is applied to said hoop in a downward direction, and to return to a normal horizontal orientation after release of said force; and wherein the method comprises the further steps of providing longitudinally expandable and contractable axle means for engaging said bracket to said frame support; and camming one of said axle means in a slot in said frame support so as to control the downward pivoting of said basketball hoop secured therewith.

4. The method of improving the shooting accuracy of a basketball player playing the game of basketball, as recited in claim 3, including the step of:

controlling the downward movement of a basketball hoop during a slam dunk by arranging a piston and cylinder unit onto said cammed axle means to slowly absorb the force of said slam dunk, and to subsequently return said hoop to its proper horizontal orientation.

* * * * *